United States Patent [19]

Mitchell

[11] 4,398,313

[45] Aug. 16, 1983

[54] MANUAL CONTROL SYSTEM FOR ADJUSTABLE HOSPITAL BED

[75] Inventor: Larry D. Mitchell, Manchester, Mo.

[73] Assignee: B-W Health Products, Inc., Maryland Heights, Mo.

[21] Appl. No.: 211,543

[22] Filed: Dec. 1, 1980

[51] Int. Cl.[3] ..... A47C 19/00

[52] U.S. Cl. ..... 5/66; 5/68

[58] Field of Search ..... 5/60, 63, 66–69; 192/48.2, 48.8, 84 AA, 83

[56] References Cited

U.S. PATENT DOCUMENTS

| | | | |
|---|---|---|---|
| Re. 27,966 | 4/1974 | Burst | 5/67 |
| 750,370 | 1/1904 | Kammerer | 192/84 AA |
| 1,810,317 | 6/1931 | Lasker | 192/183 X |
| 1,985,394 | 12/1934 | Anderson | 192/48.2 X |
| 2,057,517 | 10/1936 | Finnegan | 192/48.2 X |
| 2,481,477 | 9/1949 | Peery | 5/68 X |
| 3,282,584 | 11/1966 | Anderson | 5/66 |
| 3,333,574 | 8/1967 | Harris | 192/48.2 X |
| 3,465,373 | 9/1969 | Wilson | 5/68 X |
| 4,110,856 | 9/1978 | Benoit et al. | 5/66 X |

*Primary Examiner*—Ramon S. Britts
*Assistant Examiner*—Michael F. Trettel
*Attorney, Agent, or Firm*—Gravely, Lieder & Woodruff

[57] ABSTRACT

Independently operable lifting mechanisms are provided at the head and foot ends of the fixed lower base frame of an adjustable hospital bed in order to facilitate independent height adjustment of the head and foot ends of the bed's movable upper frame. The lifting mechanisms are actuated by respective drive screws which may be rotated individually or simultaneously and in either direction to position the upper frame at any desired height and at any selected tilt angle. By turning only one drive screw, one end of the upper frame is elevated or lowered and the tilt angle will be changed. By rotating both drive screws simultaneously, the upper frame will be raised or lowered at a constant tilt angle. A manual control system provides for selective manual engagement of the lifting mechanisms and automatic disengagement thereof. When engaged, the lifting mechanisms may be manually actuated.

17 Claims, 11 Drawing Figures

12
116
22
21
18a
18b
18c
112
114
113
111
117
105
69
68
67
66
68a
69a
67a
66a
24
10b
10a
118
75
84
83
82
81
51
74
73
76
72
71
64
63
62
94
101
92
49
61
104
102
107
93
91
96
108
97
44
46

Fig. 5.
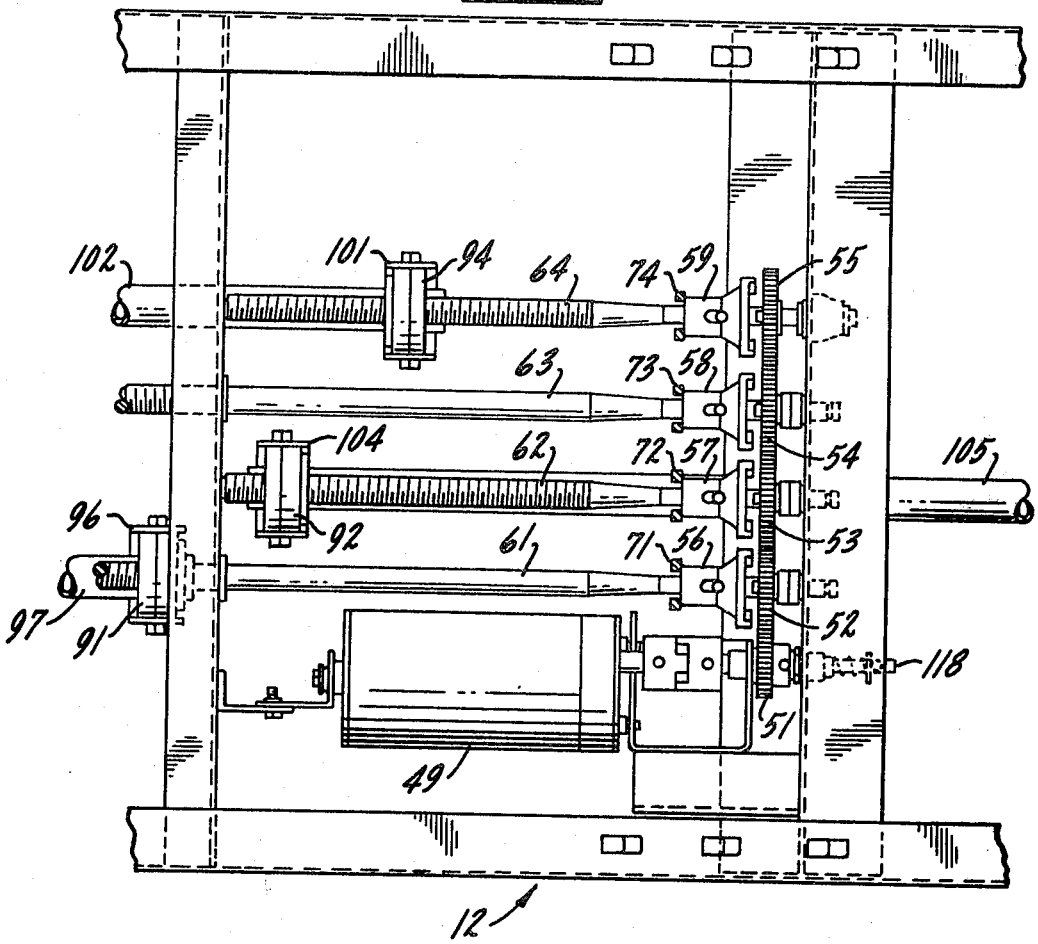
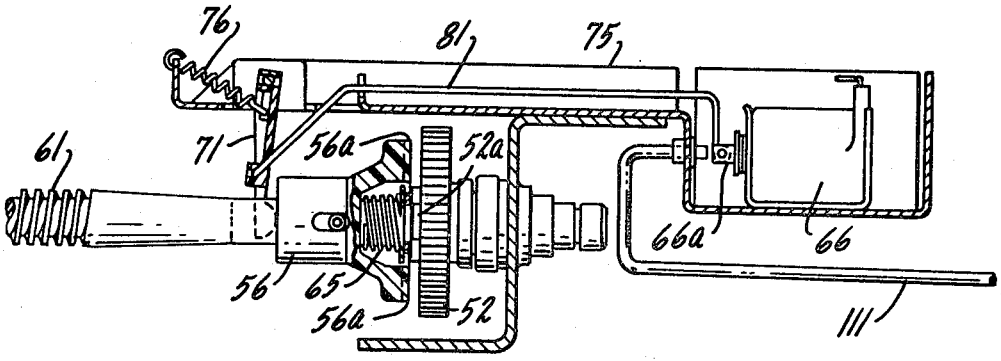
Fig. 6.

MANUAL CONTROL SYSTEM FOR ADJUSTABLE HOSPITAL BED

BACKGROUND OF THE INVENTION

This invention relates to an adjustable hospital bed having a lifting system for elevating or lowering the bed in either a horizontal or a tilted position, while at the same time permitting independent height adjustment at each end.

Adjustable hospital beds are usually vertically movable so that the mattress supporting structure may be established at a selected desired height, within a range of permissible heights, from the floor. The lowermost level is most convenient when a patient is entering or leaving the bed. On the other hand, the uppermost height is generally preferred for examination and treatment of the patient. In addition, many adjustable hospital beds may be tilted or canted to either the Trendelenburg position or to the reverse Trendelenburg position. In the Trendelenburg or shock position, the entire mattress supporting structure is tilted between 10° and 20° from horizontal so that the patient's head lies below his or her legs. In the reverse Trendelenburg or drainage position the patient's head is above his or her legs.

To maximize the vertical adjustment range or travel in prior hospital beds, without sacrificing stability, the mattress supporting structure is customarily mounted on a movable upper frame which interconnects, via head and foot elevating linkage systems, to a fixed lower base frame located close to the floor. The elevating linkage systems are actuated to either lift or lower the upper frame, and consequently the mattress supporting structure, as desired. For Trendelenburg or reverse Trendelenburg positioning, the hospital bed usually must first be placed at a predetermined height and then actuated to the desired tilt position.

The hospital bed of the present invention is capable of assuming not only all of the various positions of the prior hospital beds but in addition a variety of other positions are obtainable. Moreover, this is achieved with a unique construction which is considerably simpler and more reliable than those of the previously developed hospital beds. A salient feature of the invention is the capability of actuating the bed manually. It may be actuated to its Trendelenburg or reverse Trendelenburg position from any level, and may be tilted in either direction, to any tilt angle, regardless of the height of the bed at the time. This feature, among other advantages, results in a significant time saving when adjusting the bed.

SUMMARY OF THE INVENTION

The adjustable hospital bed of the present invention comprises a stationary lower base frame and a movable upper frame, each of the frames having head and foot ends. A head lifting mechanism, mounted on the lower base frame at its head end, is provided for raising and lowering the head end of the upper frame. There is a foot lifting mechanism, mounted on the lower base frame at its foot end, for raising and lowering the foot end of the upper frame. Means, including a rotatable head drive screw, are included for operating the head lifting mechanism to adjust the height of the upper frame's head end. Means, including a foot drive screw which is independently rotatable relative to the head drive screw, operates the foot lifting mechanism to adjust the height of the upper frame's foot end. Finally, the adjustable hospital bed comprises power and manual means for rotating the drive screw individually or collectively and in either direction in order to position the upper frame at any selected desired height and at any selected desired tilt angle.

DESCRIPTION OF THE DRAWINGS

The features of the invention which are believed to be novel are set forth with particularity in the appended claims. The invention may best be understood, however, by reference to the following description in conjunction with the accompanying drawings in which like reference numbers identify like elements, and in which:

FIG. 5 is a fragmentary top view showing some of the parts hidden in the FIG. 3 view;

FIG. 6 is a fragmentary side view, partially in section, of some of the elements of the manual control system;

DESCRIPTION OF THE ILLUSTRATED EMBODIMENT

Figure 1:
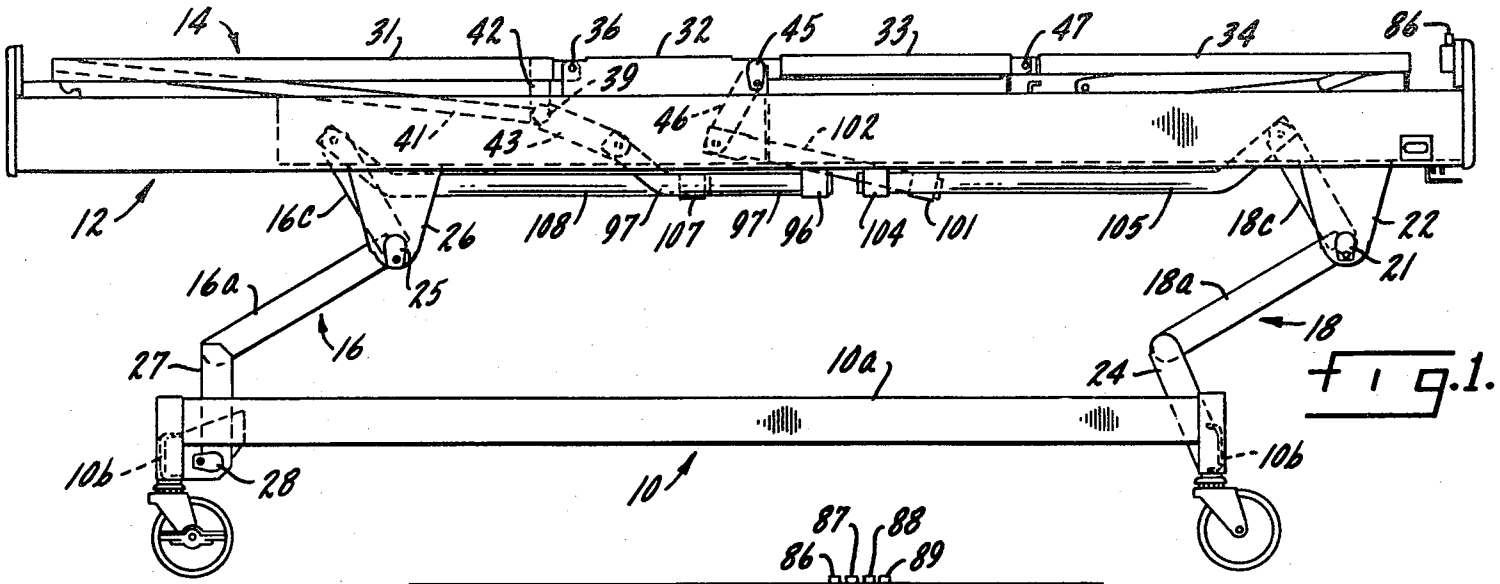
FIG. 1 is a side view of an adjustable hospital bed constructed in accordance with one embodiment of the invention, the bed being illustrated with its two lifting mechanisms placing the bed in a normal horizontal position with the head end on the left and the foot end on the right.

The disclosed hospital bed includes a stationary or fixed lower base frame 10 (see particularly FIGS. 1 and 2), and a movable upper frame 12 on which is mounted an articulated mattress supporting structure 14. Frame 10 has a pair of longitudinal bars or rails **10*a* with a pair of transverse or cross bars 10*b* at the foot and head ends. Movable frame 12 is supported on and is vertically adjustable with respect to fixed frame 10 by means of head and foot lifting mechanisms or elevating linkage systems 16, 18, respectively, which together provide a parallelogram lifting system. It will be apparent, however, that the invention may be employed with other lifting systems, such as a trapezoidal system. Elevating linkage system 18 takes the form of a lift yoke having a pair of channel shaped long lever or lift arms 18*a* rigidly affixed to a pivot or torque tube 18*b* (see FIG. 2) which in turn is pivotally attached by means of pivot studs 21 to a pair of brackets or lift support plates 22 rigidly secured to upper frame 12. The lift yoke also includes a pair of short lever arms 18*c* rigidly affixed to pivot tube 18*b*. The lower or free end of each lever arm 18*a* pivotally connects to a pair of brackets 24 rigidly affixed to the cross bar 10***b* at the foot end of base frame 10. It should be apparent that by moving the free or upper ends of short lever arms 18*c* to the right, as viewed in FIGS. 1 and 4, to effect clockwise rotation of yoke 18 around pivot studs 21, brackets 22 and consequently the foot end of upper frame 12 will be lowered. On the other hand, if lever arms 18*c* are moved to the left to rotate yoked 18 in a counterclockwise direction, brackets 22 and the foot end of frame 12 will be raised.

Although the drawings do not include an end view of the head end of the bed, it will be understood that head elevating linkage system 16 takes the form of a lift yoke of similar construction to yoke 18, having a pair of long lever arms 16*a* rigidly secured to a pivot or torque tube to which is also rigidly affixed a pair of short lever arms 16*c*. By means of a pair of pivot studs 25, the pivot tube is rotatably mounted to a pair of lift support plates or brackets 26 rigidly secured to frame 12. The lower or free ends of lever arms 16*a* are pivotally coupled to the upper ends of brackets 27, the lower ends of the brackets being pivotally attached to frame 10 by means of pivot studs 28. In similar fashion to the operation of yoke 18, when the upper ends of lever arms 16*c* are moved to the right (as viewed in FIG. 1) yoke 16 rotates clockwise around pivot studs 25 causing brackets 26 and the head end of upper frame 12 to descend. Conversely, when lever arms 16*c* are moved to the left, counterclockwise rotation results and the head end of frame 12 moves upwardly. The lower ends of brackets 27 are pivotally coupled to base frame 10 by studs 28 to allow the bed to assume its various positions.

Figure 2:
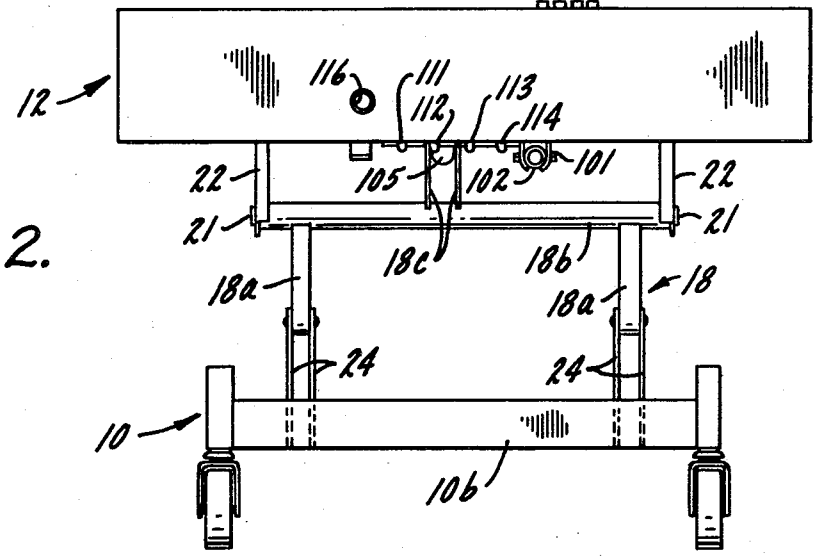
FIG. 2 is a view of the foot end of the bed of FIG. 1.

Articulated mattress supporting structure 14 is divided into four interconnected sections or panels, namely a back support section 31, a center or seat support section 32, an upper knee or thigh support section 33 and a lower knee or foot section 34. Each of the four support sections preferably takes the form of a perforated metal panel, but of course other constructions could be employed. For example, each mattress support section may constitute a bed spring. Seat support section 32 is rigidly affixed to frame 12, while one side or edge of back support section 31 is pivotally connected, by means of a pair of pivot studs 36 (only one of which is shown in FIG. 1), to seat support section 32. As will be described, adjusting means are provided for tilting back section 31 upward, with respect to fixed seat section 32, to raise the back and head of the patient occupying the bed to maximize comfort. The tilting is achieved by a torque or pivot tube 39 (see FIG. 1) secured to back section 31 by rigid structural members 41 and 42. A pair of lever arms 43 (only one of which is shown in FIG. 1) are rigidly affixed to tube 39 in order to facilitate turning of the tube. As the free ends of lever arms 43 are moved to the left, as viewed in FIG. 1, tube 39 rotates in a clockwise direction thereby tilting back support section 31 upward.

Figure 3:
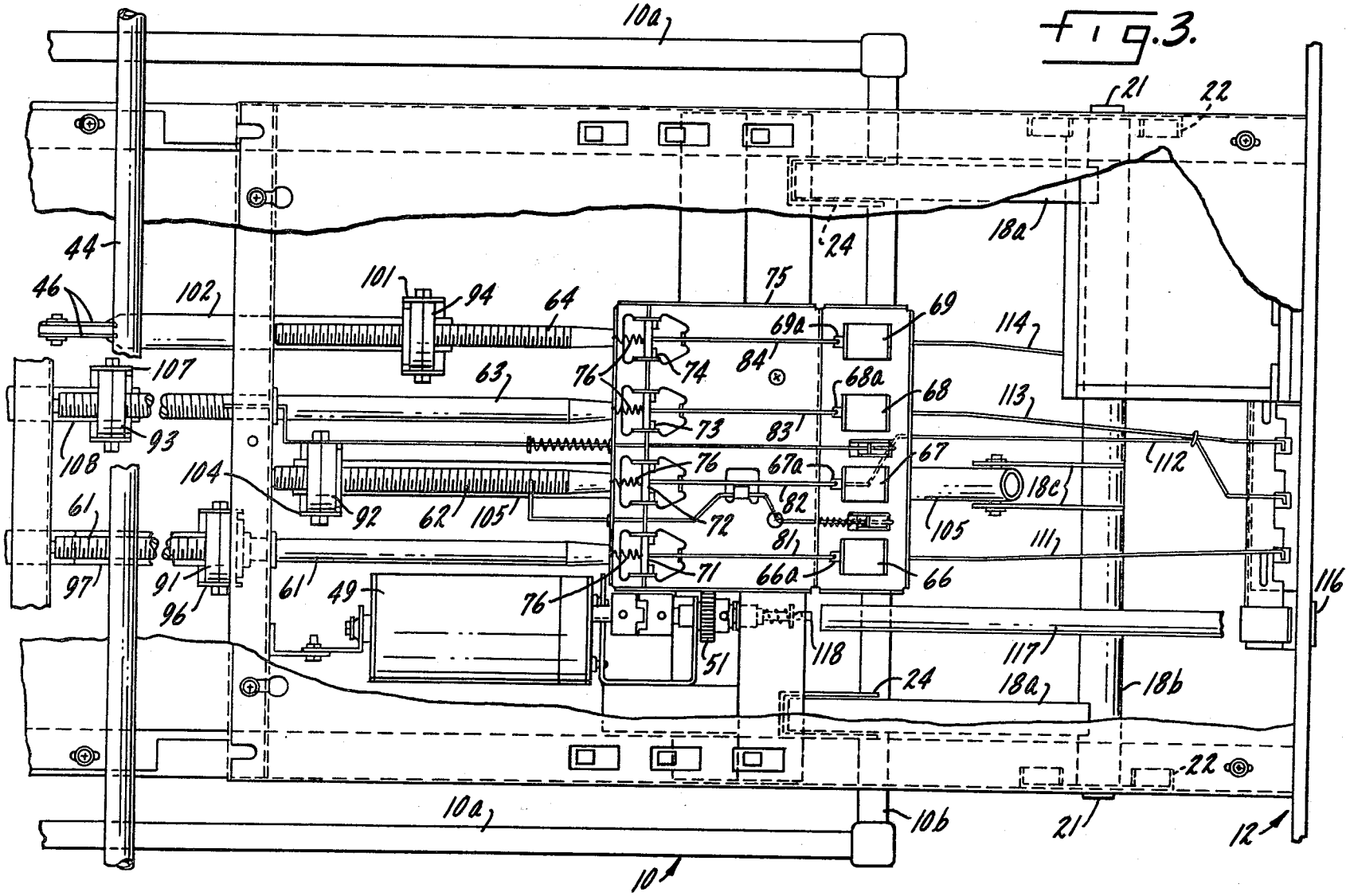
FIG. 3 is a fragmentary and partially broken away top or plan view of the bed of FIG. 1 on an expanded scale.
Figure 4:
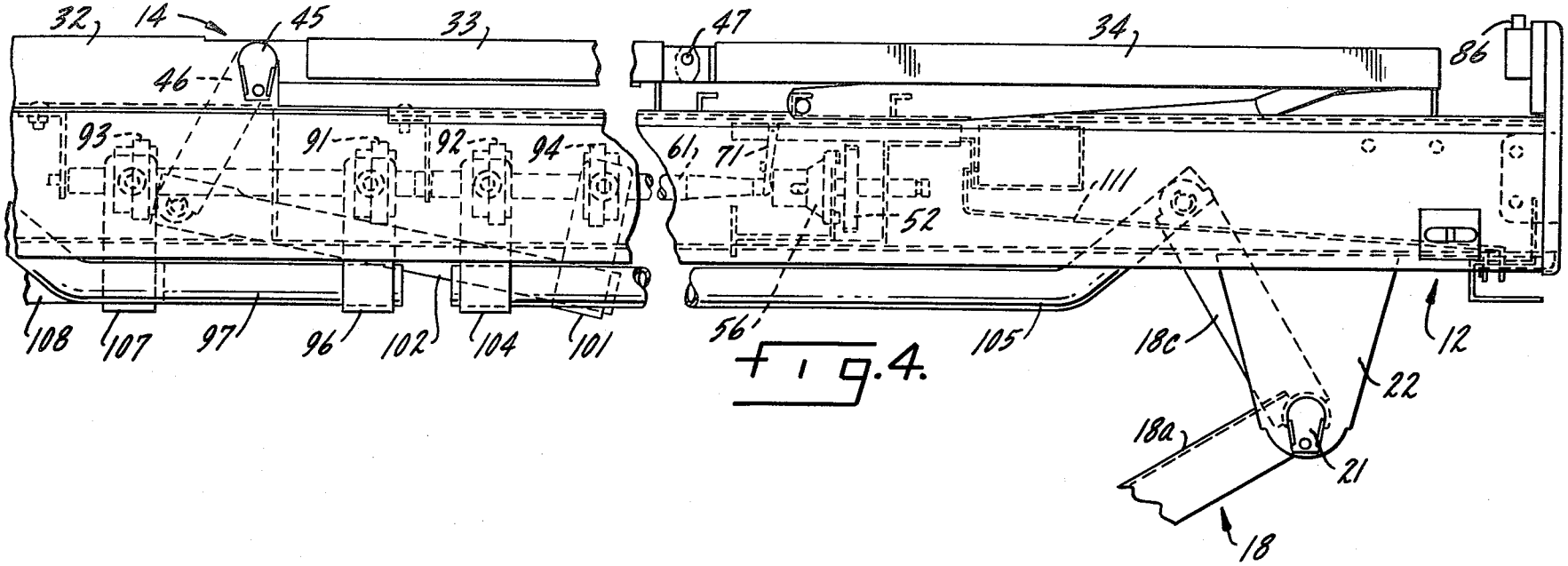
FIG. 4 is a fragmentary side view of the bed showing the side view of some of the parts illustrated in FIG. 2 and on the same scale as FIG. 3.

The adjacent sides of knee support sections 33 and 34 are pivotally interconnected by a pair of pivot studs 47, only one of which is shown in FIGS. 1 and 4. The left side of section 33 (as viewed in FIGS. 1 and 4) rigidly attaches to a torque or pivot tube 44 (see FIG. 3) which is rotatably mounted to seat support section 32 by pivot studs 45, only one of which is seen in FIGS. 1 and 4. A pair of lever arms 46 (see FIGS. 1, 3 and 4) are rigidly secured to torque tube 44 so that movement of the free ends of those arms toward the right (as viewed in FIGS. 1 and 4) results in counterclockwise pivoting of tube 44 around pivot studs 45. Upper knee support section 33 therefore tilts upward and since that section is pivotally connected to lower knee support section 34 by studs 47, the left side of section 34 will be raised. Sections 33 and 34 will thus form an inverted V in order to raise the patient's knees. Adjusting means will be described for pivoting lever arms 46 to effect a desired knee adjustment to maximize the patient's comfort.

The movable members 16, 18, 31, 33 and 34 may all be actuated, either individually or collectively, by a single reversible or bidirectional electric motor 49 (see FIGS. 3 and 5) supported on upper frame 12. When energized, motor 49 drives gear 51 which in turn rotates the four intercoupled driven gears 52–55, Each of the gears 52–55 couples, via a respective one of four clutches 56–59, to a respective one of four screw-threaded drive shafts or drive screws 61–64, screws 61, 62 and 64 having left-handed threads while screw 63 has right-handed threads. Clutches 56–59 are normally spring biased out of engagement with their respective gears 52–55. The gears and clutches have dogs or lugs which interlock when engaged in order that gear rotation will be transferred to the associated drive screw. Attention is directed particularly to FIG. 6 which illustrates, in greater detail, the construction of clutch 56 and the apparatus for controlling it. Of course, since all of the clutches 56–59 are of similar construction only one is shown in FIG. 6 and the explanation of its construction and operation applies to all of the other clutches. The spring biasing of clutch 56 is accomplished by coil spring 65 which pushes the clutch to the left and out of engagement with gear 52. Lugs 52*a* on gear 52 and lugs 56*a* on clutch 56 interlock when the clutch is moved to the right and into engagement with the gear. Each of clutches 56–59 is actuated into engagement with its associated gear by a respective one of four solenoids 66–69 (see FIG. 3) which actuate U-shaped yokes 71–74, respectively. Each of yokes 71–74 is pivotally connected to support pan 75 (mounted on frame 12) and straddles a respective one of drive screws 61–64 and abuts the screw's clutch. Coil springs 76 bias the free ends of yokes 71–74 so that minimal pressure is normally applied to the clutches by the yokes. Actuation of each yoke in response to energization of its associated solenoid is achieved by means of linkages or rods 81–84 each of which connects a respective one of yokes 71–74 to a respective one of movable cores 66*a*–69*a* of solenoids 66–69, respectively. This construction is clearly illustrated in FIG. 6.

When motor 49 is rotating, thereby rotating all of gears 52–55, and a selected solenoid is energized, the yoke associated with the solenoid will be pulled to the right as viewed in the drawings, to actuate or move its clutch into engagement with its associated one of gears 52–55, thereupon causing rotation of the associated drive screw in response to the gear rotation. In short, any time motor 49 is energized, all of gears 52–55 will be rotating and by energizing a selected one or more of solenolids 66–69 a corresponding selected one or more of drive screws 61–64 will be rotated. Of course, the rotational directions of the drive screws will depend on the direction of motor 49, but since that motor is reversible it is possible to rotate each of screws 61–64 in either of its two directions. Any appropriate electrical circuitry may be employed to contol the energization of motor 49 and of solenoids 66–69 to achieve the desired actuation of drive screws 61–64. A relatively simple circuit will achieve the necessary operation. The circuitry may be controlled by switches actuated by the four manually operated switch actuators 86–89 (see FIG. 2) mounted at the foot end of upper frame 12. In effect, each of switch actuators 86–89 may control the energization of a respective one of solenoids 66–69, while at the same time controlling the direction of motor 49. For example, each actuator may be a push button of the rocker type which may be depressed or rocked in one direction to energize the associated solenoid and to operate the motor in one direction, and which may be rocked in the other direction to energize the same solenoid but to operate the motor in its other direction. Preferably, the patient occupying the bed will have a remote control device for remotely controlling the circuitry for the motor and solenoids. Such a control device may either be held by the patient or removably attached to the bed.

The rotational motion of screws 61–64 is converted to lineal motion by the four drive mechanisms 91–94, respectively, the movements of which cause adjustment of the bed. Each of these mechanisms includes an internally-threaded collar or clutch not threadedly engaged on its associated drive screw. The collar or nut is held against rotation by friction imposed on it by a non-rotatable housing which surrounds the nut. The design of each nut and clutch joint is such that the total friction generated by the clutch joint will be greater than the friction generated between the drive screw threads interacting with the nut threads. Hence, as a drive screw rotates, its associated drive mechanism, namely its clutch nut and housing, will travel linearly and axially along the screw. Although not shown, pins may be provided on each drive screw to define the limits of travel of the associated drive mechanism, the pins rotating with the drive screw. When a drive mechanism travels along its drive screw to a limit of travel established by a pin, the clutch nut in the mechanism will engage the pin and its linear travel will be terminated even though the drive screw continues to rotate. The rotating pin rotates the nut within its housing, the nut thereby free wheeling, as the drive screw rotates. The nut housing, and consequently the drive mechanism, therefore remains axially stationary on the rotating drive screw. Thus, continued rotation of a drive screw after its drive mechanism has reached a limit of travel results in no axial movement of the drive mechanism. This feature precludes the need for electrical switches to de-energize the motor when the bed adjustments reach their extreme positions.

Drive mechanism 91 pivotally couples to a linkage or bracket 96 rigidly affixed to a thrust. Also on tube 97 which in turn is pivotally connected to the free ends of lever arms 43. When drive screw 61 is rotated in the direction which causes drive mechanism 91 to move linearly to the left (as viewed in the drawings), arms 43 and torque tube 39 will be rotated in a clockwise direction and back support section 31 will be tilted upward. Opposite rotation of drive screw 61 will lower section 31 from its tilted position. Screw 61 may thus be referred to as the "back drive screw". In similar fashion, drive mechanism 94 pivotally connects to linkage or bracket 101 which is rigidly secured to one end of a thrust tube 102. The other end is pivotally coupled to the free ends of lever arms 46 in order that rotation of drive screw 64 (which may be called the "knee drive screw") will rotate tube 44 to raise or lower the knee support sections 33 and 34.

Movement of drive mechanism 92 results in actuation of foot elevating linkage system 18 to raise or lower the foot end of upper frame 12, depending on the rotational direction of drive screw 62, referred to as the "foot drive screw". More specifically, the clutch nut housing of drive mechanism 92 is pivotally coupled to a bracket or linkage 104 which rigidly connects to one end of a thrust tube 105, the other end of which pivotally connects to lever arms **18*c*. When foot drive screw 62 is rotated in the direction to move drive mechanism 92, and consequently tube 105, to the right in the drawings, lever arms 18*c* will be rotated in a clockwise direction causing the foot end of frame 12 to descend. Conversely, opposite direction rotation of screw 62 results in counterclockwise rotation of yoke 18** and raising of the upper frame's foot end.

The head elevating linkage system 16 functions in similar manner to effect independent raising and lowering of the head end of frame 12. Drive mechanism 93 is pivotally coupled to linkage or bracket 107 which rigidly attaches to one end of a thrust. Also on tube 108, the other end being pivotally coupled to the free ends of lever arms **16*c*. When drive screw 63 (called the "head drive screw") rotates in the direction required to move drive mechanism 93 to the right, tube 108 will cause clockwise rotation of yoke 16 with resultant lowering of the head end of frame 12. On the other hand, opposite direction rotation of head drive screw 63 effects counterclockwise rotation of yoke 16** and raising of the frame's head end. Note that the lifting loads are divided between the two screw/nut combinations. Among other advantages, this reduces wear on the mechanical elements.

It will now be apparent that since each of lifting mechanisms 16 and 18 and its driving apparatus is entirely independent of the other lifting mechanism and its driving apparatus, the head and foot ends of upper frame 12 may each be positioned at any selected level or height, as a consequence of which frame 12 may be made horizontal or tilted and may be established at any desired level. When upper frame 12 is horizontal and both of drive screws 62 and 63 are rotating simultaneously or collectively, the frame is elevated or lowered in its horizontal position. When the foot drive screw 62 is not rotated but the head drive screw 63 is, the head end of frame 12 is raised to establish the bed in the reverse Trendelenburg position. When the foot end of frame 12 remains at the same height and the head drive screw 63 is rotated in the opposite direction, the upper frame's head end is lowered to place the bed in the Trendelenburg position. When, starting from the tilted position, drive screws 62 and 63 are rotated simultaneously, the entirety of frame 12 is elevated or lowered while it remains tilted.

Hence, frame 12 can be tilted at any height and the height may be changed while at any tilt angle. Also the tilt angle may be changed by raising or lowering either end of frame 12 thus obtaining a desired tilt angle without changing the height of one end. Of course, the head and foot lifting mechanisms are independently operable even when the back support section 31 and the knee support sections 33 and 34 are tilted relative to seat section 32. Since the bed can be shifted immediately to the Trendelenburg position, without first going to an extreme upper or lower horizontal position, considerable time can be saved, and time is usually of the essence when a patient goes into shock.

It will also be appreciated that the operational flexibility afforded by the present invention is of considerable value since the patient treatment supplied by associated equipment, drainage bags, traction equipment, etc., is affected by the bed height. In addition, the bed height affects the ability of the medical staff to treat the patient. Significantly improved mechanical treatment may thus be obtained with the hospital bed of the present invention.

Of course, by the proper selection of the tread directions of drive screws 61 and 64, back support section 31 and knee support sections 33 and 34 may be adjusted in a desired direction at the same time that upper frame 12 is moving in a given predetermined direction. For example, it may be desirable to lower all of sections 31, 33 and 34 to their horizontal positions (shown in FIG. 1) as frame 12 is simultaneously being raised. This would expedite the establishment of the bed in the preferred patient examination position. It is also apparent that by employing four separate bidirectional motors, each of which drives a respective one of screws 61–64, still greater flexibility of operation is obtained when two or more bed adjustments are to be made at the same time.

Figure 7:
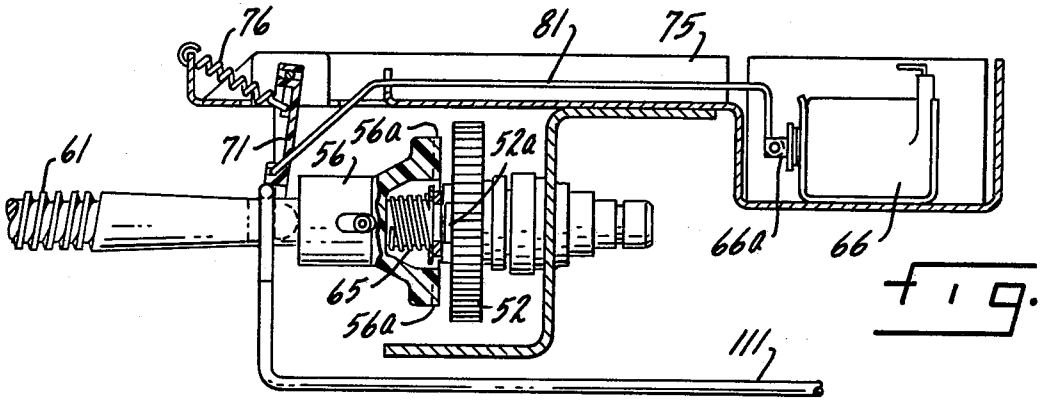
FIG. 7 is a fragmentary side view, partially in section, of an alternative arrangement of the elements of FIG. 6.

In the event of a power failure, thereby precluding the operation of motor 49 and solenoids 66–69, clutch operating elements or linkages in the form of relatively rigid wires or rods 111–114 are provided to allow the nurse or attendant to manually depress the cores of the solenoids from the foot end of the bed. This is shown in FIG. 6. For example, by pulling linkage 111 to the right, core 66*a* of solenoid 66 is depressed to the right and into the solenoid winding in the same manner as if the solenoid had been energized electrically. Alternatively, wires or rods 111–114 may be looped over drive screws 61–64, respectively. This allows the nurse or attendant to manually pivot yokes 71–74 and thereby engage clutches 56–59 selectively, as desired. This is shown in FIG. 7. Gears 52–55 may then be driven by inserting a hand crank (not shown) through opening 116, at the foot end of frame 12 (see FIGS. 2 and 3), and then through tube 117, mounted on frame 12, for engagement with shaft 118 which is coupled to driving gear 51. By hand cranking shaft 118, gear 51 may be rotated to in turn rotate gears 52–55 in the same manner as if motor 49 was rotating. Hence, by manipulating selected ones of linkages 111–114 and by hand cranking shaft 118 all of the bed adjustments may be made.

Rods 111–114, opening 116, tube 117 and shaft 118 form a portion of a manual control system 120. Control system 120 also includes a plate 122 secured to frame 12. Plate 122 defines a plurality of spaced openings 124 through which extend, respectively, rods 111–114. In a preferred form of the invention, openings 124 have a square configuration. Plate 122 also defines a pair of pins 126.

A slidable plate 128 defines a plurality of spaced surfaces 130 and, offset therefrom, a plurality of associated spaced surfaces 132. Plate 128 also defines slots 134 through which extend pins 126. Plate 128 is guided thereby for sliding movement relative to plate 122 between the first position shown in FIG. 8 and the second position shown in FIG. 9. A suitable spring 136 biases plate 128 toward its first position.

Plate 128 includes an arm 138 having a lower handle portion 140. When plate 128 is in its first position, arm 138 is between opening 116 and tube 117 to thereby block insertion of an associated hand crank into tube 117. A nurse or attendant may grasp handle 140 and slide plate 128 to its second position against the biasing force of spring 136. When plate 128 and arm 138 are in this position, a hand crank may be inserted through opening 116 and tube 117 into engagement with shaft 118. In this manner, gears 51–55 may be rotated manually.

Figure 8:
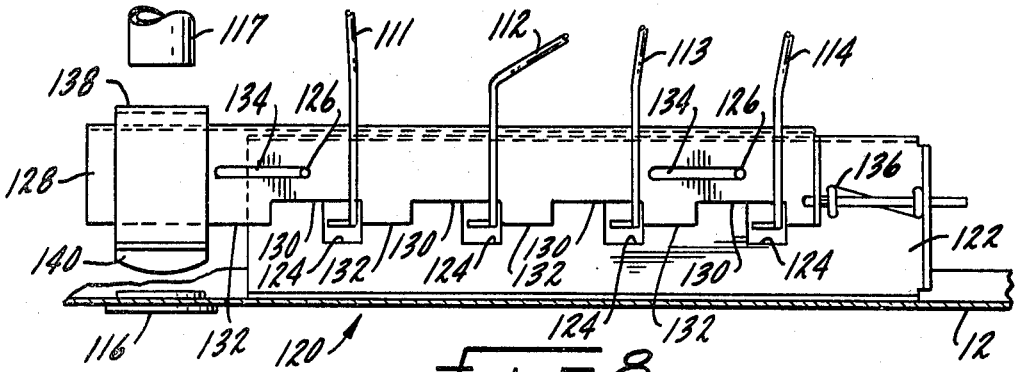
FIG. 8 is a fragmentary plan view of some of the elements of the manual control system in the disengaged position.

With plate 128 in its first position, openings 124 have the square configuration shown in FIG. 8. Springs 76 pivot yokes 71–74 clockwise as shown in FIGS. 5, 6 and 7. Clutches 56–59 are biased to their disengaged position.

Figure 9:
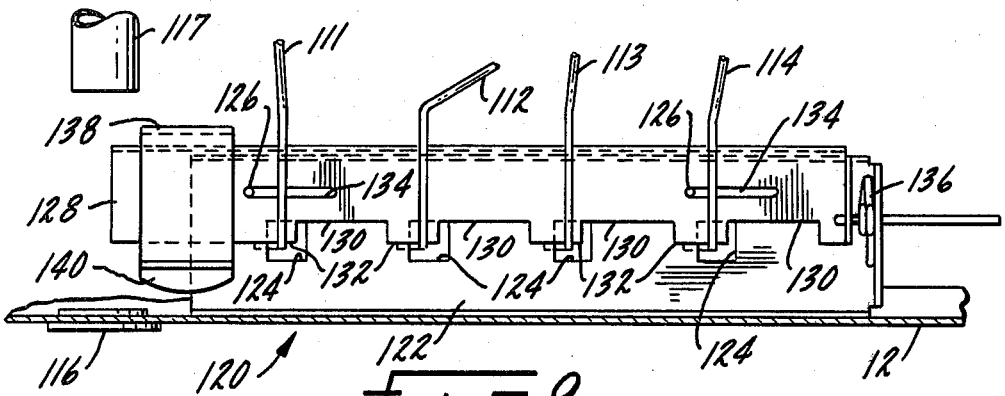
FIG. 9 is a fragmentary plan view of some of the elements of the manual control system in the engaged position.
Figure 10:
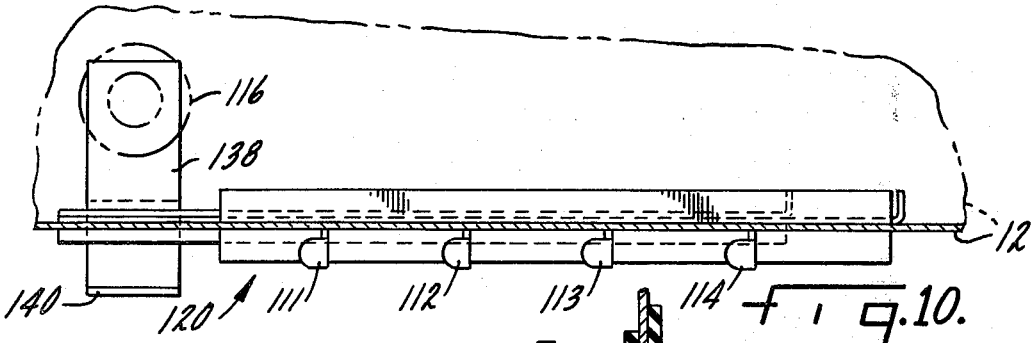
FIG. 10 is a side view of the elements shown in FIG. 8.
Figure 11:
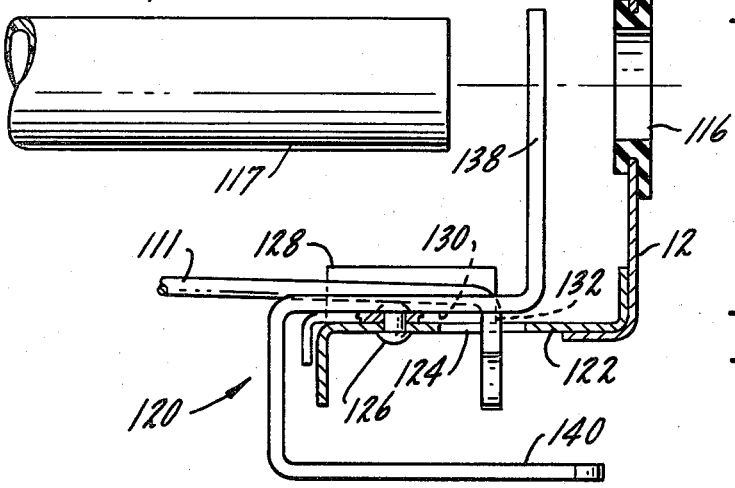
FIG. 11 is an end view of the elements shown in FIG. 10.

As plate 128 slides to its second position, surfaces 132 thereof slide partially across their associated openings 124. As shown in FIG. 9, openings 124 assume an L-shaped configuration. Any number of rods 111–114 may be pulled downwardly and leftwardly (reference being to FIG. 8) to selectively engage clutches 56–59. This is accomplished either by depression of solenoid cores 66*a*–69*a* to the right as shown in FIG. 6 or, alternatively, direct counterclockwise pivotal movement of yokes 71–74 against the biasing force of springs 76 as shown in FIG. 7. Rods 111–114 are held against upward movement as shown in FIG. 9 by surfaces 132 of plate 128. Thus, when the plate 128 is in its second position, it functions as a latch for holding any of the rods 111–114 outwardly, that is in the position in which the rods 111–114 engage their respective clutches 56–59.

This condition will obtain so long as an associated hand crank remains inserted through opening 116 and tube 117. When the hand crank is withdrawn, plate 128 slides back to its first position under the biasing force of spring 136. Clutches 56–59 are disengaged.

Thus, it should be apparent that any one or more functional bed adjusting operations may be selected manually. The operations so selected may be effected simultaneously by manually rotating gears 51–55.

In this connection, it should be realized that the invention does not require an electrically-operated or motorized bed. The invention could obviously be incorporated in a hand cranked bed which always has to be cranked when an adjustment is desired. It should also be appreciated that the lifting mechanisms may take different forms. While a parallelogram lifting system is employed in the illustrated embodiment, other systems, such as a trapezoidal lifting system, could be used. In the illustrated parallelogram lift, the head and foot drive mechanisms travel in the same linear direction when the upper frame is being raised or lowered. With a trapezoidal lift, the two drive mechanisms would be moving in opposite directions when the upper frame is being elevated or lowered.

Certain features disclosed in the present application are described and claimed in concurrently filed copending patent application Ser. No. 211,544 which is assigned to the present assignee.

While a particular embodiment of the invention has been shown and described, modifications may be made, and it is intended in the appended claims to cover all such modifications as may fall within the true spirit and scope of the invention.

I claim:

1. An adjustable bed including a relatively fixed frame; a movable frame; a mattress support structure; head and foot lift mechanisms for raising and lowering the head and foot ends respectively of said movable frame; back and knee lift mechanisms for raising and lowering the back and knee sections respectively of said mattress support structure; power actuating means including transmission means engageable for directing torque to said lift mechanisms for actuation thereof, said transmission means including head, foot, back and knee ift screws respectively in driving relationship with said ift mechanisms, a gear train including a drive gear and head, foot, back and knee driven gears in meshing relationship with said drive gear, and head, foot, back and knee clutches selectively engageable for respectively establishing engagement of said driven gears with said ift screws, and motor means for supplying torque to said drive gear; and manual actuating means including control means for selectively engaging said transmission means with any number of said lift mechanisms for simultaneous actuation thereof, said control means including manually actuated head, foot, back and knee selecting means for selectively effecting engagement of any number of said clutches, and a hand crank engageable with said drive gear, said selecting means including a fixed plate defining head, foot, back and knee openings, head, foot, back and knee selector rods respectively operatively related to said clutches and extending into said openings, said rods being movable within said openings for effecting said clutch engagement, a plate slidable between first and second positions relative to said fixed plate, said slidable plate defining head, foot, back and knee surfaces respectively cooperable with said openings when said slidable plate is in its second position such that said rods are movable for effecting said clutch engagement and also movable into contact with said surfaces for maintaining said clutch engagement.

2. The invention of claim 1, said selecting means also including means biasing said slidable plate toward its first position.

3. The invention of claim 2, said transmission means and control means being constructed and arranged such that said sliding plate blocks engagement of said hand crank with said drive gear when in its first position and unblocks engagement thereof when in its second position; and said manual actuating means being constructed and arranged such that said hand crank holds said sliding plate in its second position when engaged with said drive gear.

4. An adjustable hospital bed comprising a movable frame having head and foot ends, a head lifting mechanism for raising and lowering the head end of said upper frame, a foot lifting mechanism for raising and lowering the foot end of said upper frame, an independently rotatable head drive screw for operating said head lifting mechanism to adjust the height of the frame's head end, an independently rotatable foot drive screw for operating said foot lifting mechanism to adjust the height of the frame's foot end, a drive train engageable with said drive screws for rotating said drive screws individually or collectively and in either direction in order to position said frame at any selected desired height and at any selected desired tilt angle, power actuated clutch means for engaging said drive train selectively with said drive screws, said clutch means including solenoids having cores which are depressed when the clutch means engage said drive screws with said drive train, power drive means for operating said drive train, manually actuated engaging means for engaging said drive train selectively with said drive screws, said manually actuated engaging means including means for selectively depressing the cores of said solenoids to thereby selectively actuate said clutches, and manual drive means for operating said drive train and including a crank engageable with said drive train, said manually actuated clutch means and said manual drive means being constructed and arranged such that said clutches may remain directly actuated so long as said crank is engaged with said drive means.

5. An adjustable hospital bed comprising a movable frame having head and foot ends, a head lifting mechanism for raising and lowering the head end of said upper frame, a foot lifting mechanism for raising and lowering the foot end of said upper frame, independently rotatable head drive screw for operating said head lifting mechanism to adjust the height of the frame's head end, an independently rotatable foot drive screw for operating said foot lifting mechanism to adjust the height of the frame's foot end, a drive train engageable with said drive screws for rotating said drive screws individually or collectively and in either direction in order to position said frame at any selected desired height and at any selected desired tilt angle, power actuated clutch means for selectively engaging said drive train with said drive screws, power drive means for operating said drive train, manually actuated engaging means for selectively actuating the clutches directly to thereby engage said drive train selectively with said drive screws, and manual drive means for operating said drive train and including a crank that is engageable with said drive train, said manually actuated engaging means and manual drive means being constructed and arranged such that said clutches may remain directly actuated so long as said crank is engaged with said drive train.

6. In an adjustable bed including a plurality or power actuated lifting mechanisms engageable for effecting a plurality of bed adjustments, a plurality of clutches respectively engageable for effecting engagement of said mechanisms, and a plurality of solenoids respectively power actuated for effecting engagement of said clutches; the improvement comprising manual means for selectively effecting engagement of any number of said clutches, and manual means for simultaneously actuating those mechanisms associated with said manually engaged clutches, said manual means for effecting engagement of the clutches including a fixed plate defining a plurality of openings, a plate slidable relative to said fixed plate between a first position unblocking said openings and a second position partially blocking said openings, and a plurality of rods cooperatively engaged with said solenoids and extending into said openings, said plates and rods being constructed and arranged such that said rods do not actuate said solenoids when said slidable plate is in its first position, said rods being manually movable into contact with said sliding plate when in its second position to thereby actuate said solenoids manually.

7. In an adjustable bed including a plurality of power actuated lifting mechanisms engageable for effecting a plurality of bed adjustments, a plurality of clutches respectively engageable for effecting engagement of said mechanisms, and a plurality of solenoids respectively power actuated for effecting engagement of said clutches; the improvement comprising manual means for selectively effecting engagement of any number of said clutches, and manual means for simultaneously actuating those lifting mechanisms associated with said manually engaged clutches, said manual means for effecting engagement of the clutches including a fixed plate defining a plurality of openings, a plate slidable relative to said fixed plate between a first position unblocking said openings and a second position partially blocking said openings, and a plurality of rods cooperatively engaged with said clutches and extending into said openings, said plates and rods being constructed and arranged such that said rods do not actuate said clutches when said slidable plate is in its first position, said rods being manually movable into contact with said sliding plate when in its second position to thereby actuate said clutches directly.

8. The invention of claim 7, said manual actuating means including a crank engageable for actuating said mechanisms, and means blocking engagement of said crank when said sliding plate is in its first position and unblocking engagement thereof when said sliding plate is in its second position.

9. A hospital bed comprising: a base frame; a movable frame located over the base frame; at least one linkage arrangement extended between the base frame and movable frame for supporting the movable frame above the base frame, the linkage arrangement being adapted to elevate or depress the movable frame when moved; a mattress-supporting structure mounted on the movable frame and including at least one section that pivots relative to the movable frame; a nut engaged with each drive screw such that the nut will move axially along the screw when the screw turns; a thrust member connected between the nut on one of the drive screws and the linkage arrangement such that when the nut moves the linkage arrangement will move and change the elevation of the movable frame; another thrust member connected between a nut on another of the drive screws and the pivoted section of the mattress-supporting structure such that when that nut moves the pivoted section pivots relative to the movable frame; a drive gear at the end of each drive screw, the drive gears of all of the drive screws being connected so they rotate in unison; a solenoid-actuated clutch for coupling each drive screw with its drive gear, each clutch being capable of shifting between an engaged condition wherein it couples its drive screw with the drive gear for that screw and a disengaged condition wherein it disconnects the screw from the gear so the gear can rotate relative to the screw, each clutch being normally in its disengaged condition and moving to its engaged condition when its solenoid is energized; a motor connected with the drive gears such that it rotates those gears in unison; means for coupling a hand crank to the drive gears such that when the crank turns all of the drive gears will revolve in unison; a slutch operating linkage connected with each of the clutches and being exposed at the end of the movable frame for moving its clutch to the engaged condition without energizing the solenoid of that clutch; and latching means for on a selective basis holding each clutch operating linkage in a position that maintains the clutch to which that operating linkage is connected in its engaged condition.

10. A hospital bed according to claim 9 wherein the latching means is shiftable between an operating position, where it permits the clutch operating linkages to be held in positions which maintain their respective clutches engaged, and an inoperative position where it will not hold the clutch operating linkages.

11. A hospital bed according to claim 10 wherein the means for coupling a hand crank supports the hand crank on the movable frame so that the crank can rotate relative to that frame; and wherein the latching means is held in its operative position by the hand crank when the hand crank is coupled with the drive gears.

12. A hospital bed according to claim 11 and further comprising means for urging the latching means to its inoperative position; and wherein the latching means will shift to its inoperative position when the crank is removed from the movable frame.

13. A hospital bed comprising: a frame; movable components attached to the frame; a plurality of drive screws mounted on the frame for rotation thereon, there being a separate drive screw for each movable component; a nut on each drive screw and being connected with the movable component for that drive screw such that the position of the movable component relative to the frame will change as the nut moves along its drive screw; a rotatable drive element at the end of each drive screw, the drive elements for all of the drive screws being connected together so that they rotate in unison; a clutch at the end of each drive screw and being capable of shifting between engaged and disengaged conditions, each clutch when in its engaged condition coupling its drive screw with the drive element for that drive screw so that the drive element will turn the drive screw, each clutch when in its disengaged condition disconnecting its drive screw from the drive element for that screw so that the drive element can rotate relative to the screw; a solenoid connected to each clutch for changing the condition of the clutch; a motor connected to the drive elements for rotating them in unison; means for supporting a hand crank on the frame such that it can rotate and for further coupling the crank with the drive elements such that it can rotate all of the drive elements in unison; a clutch operating element connected with each clutch for changing the condition of the clutch when the operating element is moved, the end of the operating element being exposed along the frame near the handle of the hand crank so that the operating element may be grasped and moved by one operating the crank, whereby the clutches may be shifted selectively to their respective engaged conditions prior to turning the crank; and latching means for holding the operating elements either individually or in combination in the positions in which the clutches for those elements are in their engaged conditions, whereby the drive screw associated with any operating element that causes a clutch to be engaged will rotate when the hand crank is turned, even though the solenoid for the clutch of that drive screw is not energized.

14. A hospital bed according to claim 13 wherein the solenoids when energized shift their respective clutches to the engaged condition; and wherein the latching means is shiftable between operative and inoperative positions, the latching means when in its operative position enabling the operating elements to be held in positions in which the respective clutches for those elements are engaged, but not when in its inoperative position.

15. A hospital bed according to claim 14 wherein the means for supporting a crank permits the crank to be completely removed from the frame; and wherein the crank when it is supported by the means for supporting it and is coupled to the drive elements, holds the latching means in its operative position.

16. A hospital bed according to claim 15 and further comprising means for urging the latching means to its inoperative position, whereby the latching means will move to its inoperative position when the crank is removed from the means for supporting the crank.

17. A hospital bed according to claim 16 wherein the frame has apertures through which the operating elements extend; wherein the operating elements are bent immediately beyond the apertures; and wherein the latching means includes a latching member that shifts with respect to the frame adjacent to the apertures in the frame, the latching member having apertures that register with the apertures in the frame when the latching means is in its inoperative position and which are offset slightly with respect to the apertures in the frame when the latching means is in its operative position such that the latching member partially blocks the frame apertures, the apertures of the latching member being configured such that when the latching means is in its operative position, the bent portions of the operating elements may be hooked over the latching member to hold the operating elements in the positions in which their respective clutches are engaged.

* * * * *

UNITED STATES PATENT AND TRADEMARK OFFICE

CERTIFICATE OF CORRECTION

PATENT NO. : 4,398,313

DATED : August 16, 1983

INVENTOR(S) : Larry D. Mitchell

It is certified that error appears in the above-identified patent and that said Letters Patent is hereby corrected as shown below:

Column 5, line 52, "thrust. Also on tube 97" should be -- thrust tube 97 --.

Column 6, line 22, "thrust. Also on tube 108" should be -- thrust tube 108 --.

Signed and Sealed this

*Thirty-first* Day of *January 1984*

[SEAL]

*Attest:*

GERALD J. MOSSINGHOFF

*Attesting Officer*

*Commissioner of Patents and Trademarks*